United States Patent [19]

Burbury

[11] Patent Number: 4,650,308

[45] Date of Patent: Mar. 17, 1987

[54] METHOD AND APPARATUS FOR AUTOMATICALLY SELF-CLEANING FILM PROCESSORS

[76] Inventor: Robert L. Burbury, 955 Grace St., Elgin, Ill. 60120

[21] Appl. No.: 812,913

[22] Filed: Dec. 23, 1985

[51] Int. Cl.[4] ..... G03D 3/02; G03D 3/08

[52] U.S. Cl. ..... 354/299; 354/322; 354/324; 134/56 R

[58] Field of Search ..... 354/299, 320, 321, 322, 354/324; 134/56 R, 57 R, 58 R, 64 P, 122 P

[56] References Cited

U.S. PATENT DOCUMENTS

| | | | |
|---|---|---|---|
| 3,662,660 | 5/1972 | Layne | 354/320 |
| 3,832,730 | 8/1974 | Geyken et al. | 354/299 |
| 3,852,793 | 12/1974 | McClintock | 354/324 |
| 3,872,827 | 3/1975 | Howe et al. | 354/318 |
| 4,160,594 | 7/1979 | Geyken et al. | 354/324 |
| 4,293,211 | 10/1981 | Kaufmann | 354/324 |
| 4,402,590 | 9/1983 | Rubin | 354/324 |
| 4,428,777 | 1/1984 | Muller | 354/322 |
| 4,577,950 | 3/1986 | Mackson | 354/324 |

*Primary Examiner*—A. A. Mathews

*Attorney, Agent, or Firm*—Leydig, Voit & Mayer

[57] ABSTRACT

An automatic film processor with self-cleaning capability is provided with a built-in self-cleaning system which utilizes an automatic cycle timer to control a series of events comprising the overall sequential cleaning cycle of the film processor. When activated, the cycle timer, in conjunction with discrete draining means using solenoid operated valves, circulating system means, refilling system means and other interconnections between the various sections constituting the processor, runs the film processor through a series of sequential cleaning events involving the drainage of the developer and fixer compartments, the filling up of these compartments with cold tap water, activating the transport system and rotating the transport rollers, pumping the water throughout the circulation system and warming the water as this event continues, draining the developer and fixer compartments of the rinse water, refilling the developer and fixer departments with fresh chemical solutions from containers located externally from the processing system, refilling the wash water compartment and allowing the wash water to overflow in order to flush the exhausted chemicals down and away from the film processor. The cycle timer is programmed to allot a predefined period of time for each of these cleaning events and then the cleaning cycle ends and the processor is ready to resume its normal film processing operations. A special scrubber pad is also provided and is so positioned that it frictionally coacts with the transport rollers during the cleaning procedure and serves to keep the rollers clean of dried chemicals.

16 Claims, 13 Drawing Figures

Fig. 1.
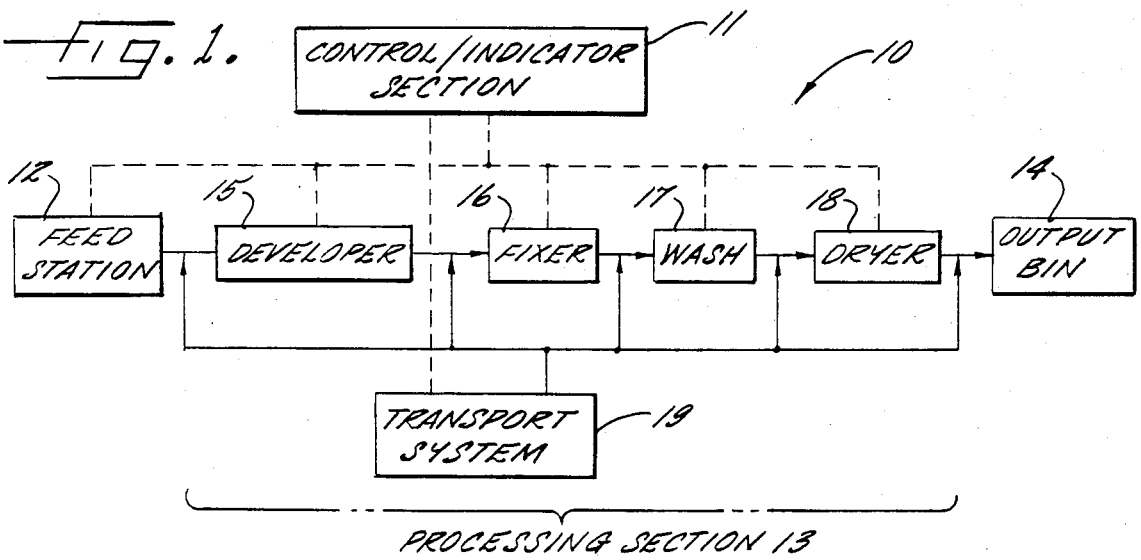
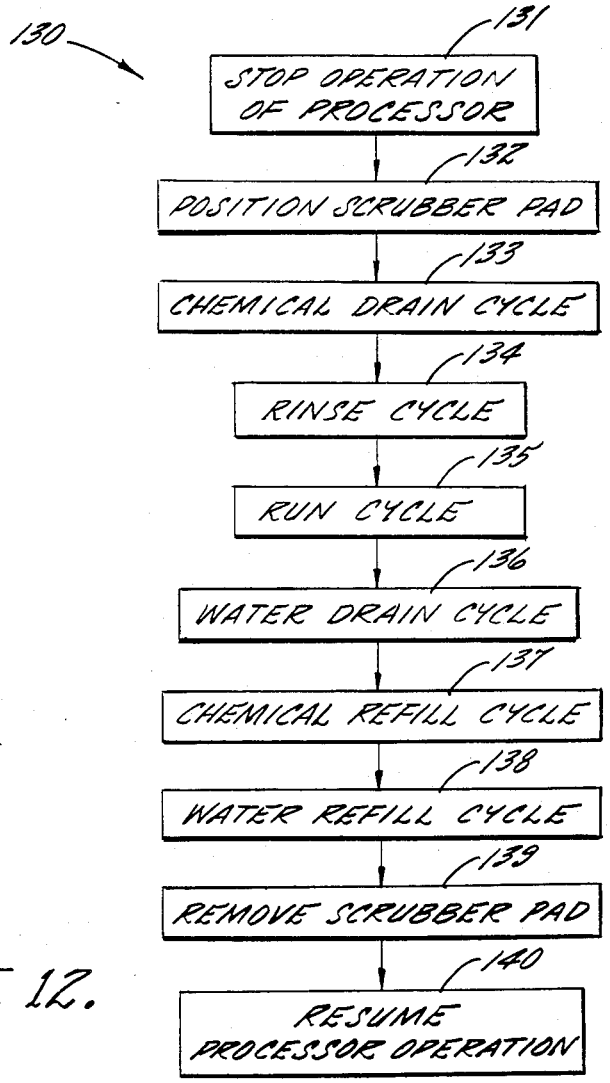
Fig. 12.

Fig. 2.
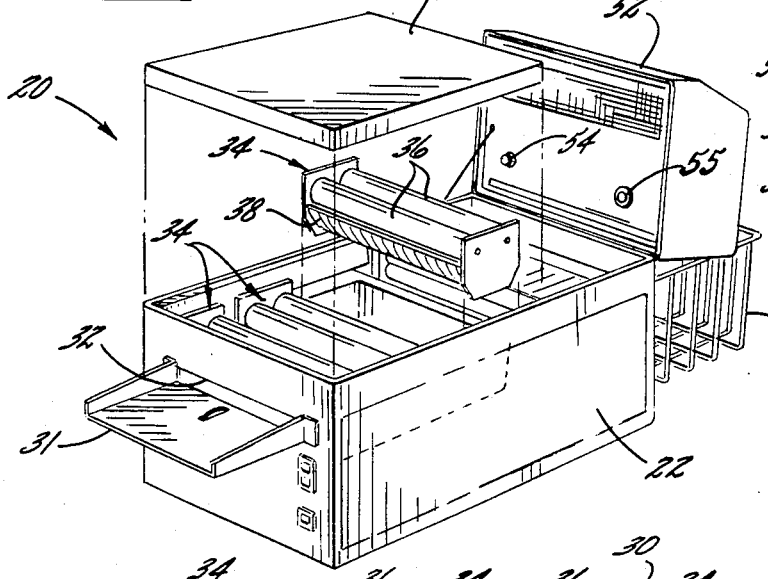
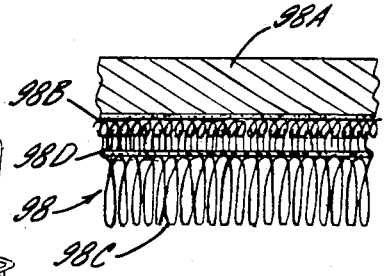
Fig. 4A.
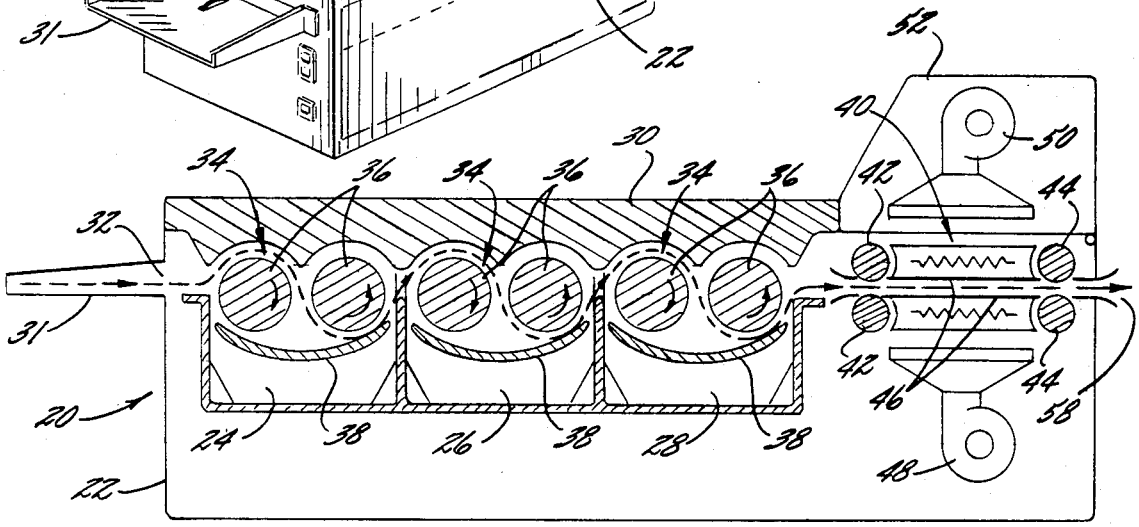
Fig. 3.
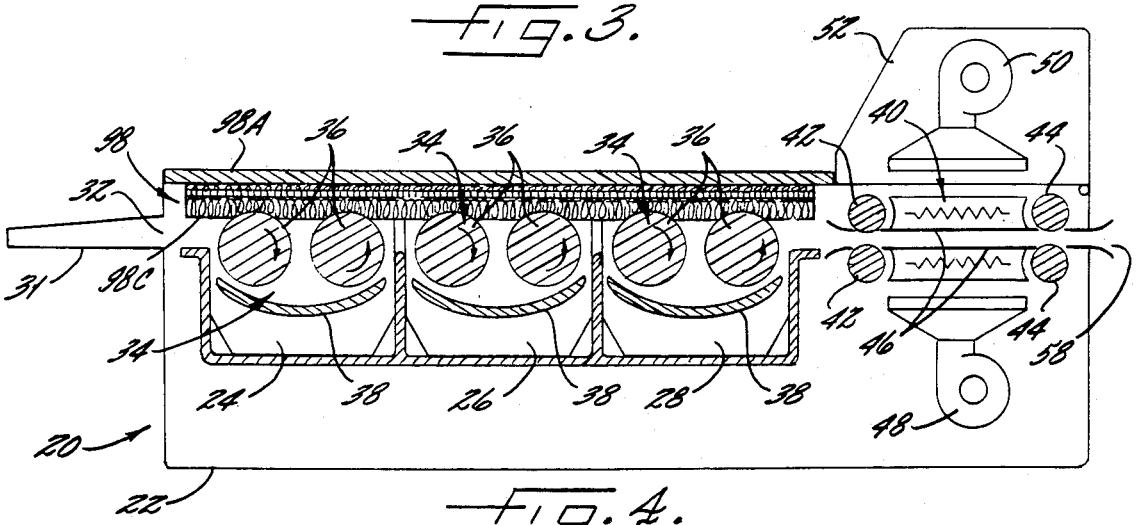
Fig. 4.

METHOD AND APPARATUS FOR AUTOMATICALLY SELF-CLEANING FILM PROCESSORS

FIELD OF THE INVENTION

This invention relates generally to the developing of X-ray films or other photo-sensitive materials. More particularly, this invention relates to automatic roller film processing apparatus for developing films exposed to various forms of energy, ranging from X-ray photons to visible light.

BACKGROUND OF THE INVENTION

A variety of automatic X-ray film processors are available which are capable of developing films exposed to various forms of energy. For example, the films may be exposed by X-ray photons produced by radiographic and floroscopic equipment, which excite phosphorus in intensifier screens which then emit variable amounts of light and act together with the X-ray photons to expose the film. Or the film might be produced from a photographic image from the face of an internal video monitor, the phosphorus on which has been excited by electrical impulses on the basis of the detection of different types of energy; in such modalities light energy, rather than ionizing radiation, exposes the film. Typical examples of such systems include computed axial tomography (CAT), ultrasound, digital radiography and magnetic resonance imaging (MRI). In all these modalities, the energy is used to expose the X-ray film and create a latent image which becomes visible during development of the film. Subsequent to the development of the recorded latent image, the film is fixed by passing it through a fixer solution which hardens and preserves the visible image, and the film is then washed and dried by the processor so that it is available immediately for analysis.

Automatic film processors eliminate manual processing problems, significantly increase the throughput and, as in the case of medical X-ray films, improve the efficiency of diagnostic imaging departments. Such automatic processors provide a means for developing radiographs faster and more conveniently, improve the consistency of the processing cycle and the quality of the resultant image, and reduce human error and artifacts from manual film handling.

Conventional automatic film processors, however, achieve the above advantages at the expense of convenience and economic as well as labor efficiency due to maintenance problems. Because automatic processors develop, wash and dry films much faster than manual methods, it is critical that they also be cleaned efficiently at some regular basis in order to maintain constant film quality and life of the equipment. Because of the inherent structure and organization of most conventional velo-type film processors, the cleaning procedure takes the form of a tedious routine and this is generally accomplished by a manual means of disassembly, cleaning and changing of the processing chemicals. In fact, the most common cause of breakdown or degradation of performance of automatic film processors is progressively unclean rollers and transport mechanisms. A related cause is improper rates of automatic replenishment of the processing chemicals. Although fluctuations in replenishment rates may be detected and controlled to some extent by sensatomitry, there still exists a definite need for regular cleaning as well as preventive maintenance of automatic film processors.

Conventional automatic X-ray film processors are hence susceptible to problems related to the scheduling of the cleaning procedure and the inconvenience and cost of the cleaning equipment as well as the required labor. There thus exists a need for automatic film processing apparatus which dispenses with the need for complicated, inconvenient and time consuming cleaning procedures typical to conventional automatic film processors.

SUMMARY OF THE INVENTION

Accordingly, it is the primary object of this invention to provide an improved automatic film processing apparatus which has the capability of automatic self-cleaning.

An important object of this invention is to provide an automatic film processor with a built-in self-cleaning system capable of automatically cycling the processor through a sequential cleaning procedure.

A related object is to provide an improved film processing apparatus of the above kind with a self-cleaning system in a form which is conveniently controlled, uses a minimal number of components and requires little maintenance.

A further object is to provide such an improved film processing apparatus in which the built-in cleaning system can be conveniently controlled so that the series of cycles comprising the sequential cleaning procedure may be easily adapted to a variety of processor cleaning requirements.

The above objects are realized in accordance with this invention, by providing a built-in self-cleaning system for the automatic film processor and by controlling the sequence of cleaning events comprising the sequential cleaning procedure by the use of an automatic cycle timer. The cycle timer in conjunction with bi-directional solenoid valves, circulating and refilling means and appropriate interconnections between the various compartments constituting the film processor, runs the processor through a series of cleaning events involving the drainage of the developer and fixer compartments, the filling up of these compartments with cold tap water, activating the transport system and rotating the transport rollers, pumping the water throughout the circulation system, and warming the water as this event continues, draining the developer and fixer compartments of the rinse water, refilling the developer and fixer departments with fresh chemical solutions from containers located externally from the processing system, refilling the wash water compartment and allowing the wash water to overflow in order to flush the exhausted chemicals down and away from the film processor. After a predetermined time during which the above sequence of events is completed, the cycle timer completes its alloted cleaning time period and the cleaning cycle ends. A special scrubber pad is also provided and is so positioned that it contacts the transport rollers during the cleaning procedure and serves to scrub the rollers clean of dried chemicals. The self-cleaning system uses a minimal number of discrete components as well as interconnections so that easy disassembly of the various components is permitted for maintenance purposes. The overall system thus provides the automatic film processing apparatus with an automatic cleaning cycle including a series of cleaning, scrubbing and chemical replenishment stages and dispenses with the need that conventional automatic film processors have for personal attention required during the cleaning procedure.

BRIEF DESCRIPTION OF THE DRAWINGS

These and other objects of the invention will become apparent from the description below when taken in conjunction with the following drawings in which:

FIG. 1 is a schematic block diagram type representation of an automatic film processor apparatus showing the various compartments constituting the processor;

FIG. 2 is a side perspective view of an automatically self-cleaning film processor according to an illustrious embodiment of this invention;

FIG. 3 is a cross sectional side view of the automatically self-cleaning appartus shown in FIG. 1 and showing clearly its compartments as well as the transport rollers;

FIG. 4 is a cross-sectional side view similar to FIG. 3 but also showing the scrubber pad in position during the automatic cleaning procedure;

FIG. 4A is an enlarged fragmental cross-sectional view of the scrubber pad illustrating the attachment of the scrubber mat to the anchoring plate;

FIG. 12 is a flow chart representation of the sequence of events involved in the automatic cleaning procedure according to the invention.

Figure 5:
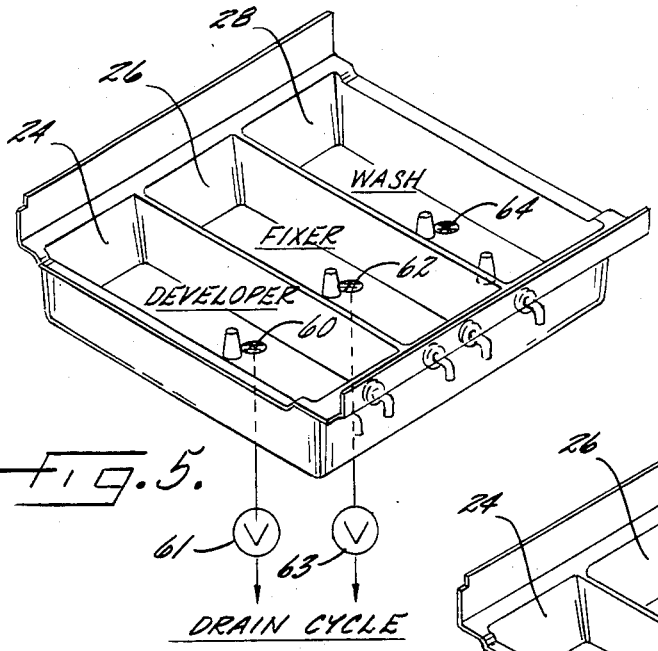
FIG. 5 is a representative diagram illustrating the action of the solenoid operated drain valves of the developer and fixer compartments during the drain cycle.

While the invention will be described in connection with certain preferred embodiments, it will be understood that it is not necessarily intended to limit the invention to those embodiments. On the contrary, it is intended to cover all alternatives, mofidications and equivalents as may be included in the spirit and scope of the invention as defined by the appended claims.

DETAILED DESCRIPTION OF THE PREFERRED EMBODIMENT

Turning now to the drawings, there is illustrated in FIG. 1, in simplified block diagram form, the generally conventional arrangement of the various sections constituting an automatic film processor. The automatic processor 10 is shown to include a control/indicator section 11 which coacts with a feed station 12, a processing section 13 and an output bin 14. The control/indicator section provides overall machine control and current status information and includes a plurality of control switches to initiate all processor functions. It is conventional for this section to also include a standby mode switch, either automatic or manual, for minimizing mechanical wear of the transport and dryer systems and reducing unnecessary water consumption during times when the processor is running idly while retaining adequate temperature requirements for film processing. A variety of status indicators such as developer and drier temperature meters, monitors for developer and fixer levels, etc., may also be located in this section.

The feed station 12 of the processor initiates the transport of the film into the processor compartments and has a feed tray with a smooth surface that provides entrance for the film's leading edge parallel to a pair of feed rollers (not shown) and minimizes misfeeds. The feed rollers function to accept the film positioned within the feed tray and convey it to the rollers constituting the transport system, but may also include means for the detection of chemical replinishment needs and for providing timing signals to insure overlap-free feeding.

After leaving the feed station, the film is transported through a processing section 13 which includes a transport system consisting of a series of rollers and guides that control the path of the film through the processor. The processing section essentially consists of a developer tank 15, a fixer tank 16, a wash tank 17, and, finally, a dryer section 18. The developer tank 15 holds a chemical solution that makes the latent image created on the exposed X-ray film visible during development of the film, while the fixer tank holds a chemical solution which functions to harden and preserve the visible or manifest image. More specifically, and as is well known, the exposing energy source reacts with the X-ray film's emulsion which is the thin light sensitive layer on which the image gets recorded. The emulsion is typically composed of gelatin and a silver salt like silver bromide, and the complex reaction causes an exchange of electrons from the bromide ions to an area where metallic silver is deposited during development. The extent to which the silver is deposited is directly proportional to the existing energy flux and, hence, a variation is recorded as X-rays are passed through areas of the subject matter with different X-ray attenuations, thereby recording on the film a latent image which has to be developed in order to transform it into a visible image. The chemical solution in the developer tank reduces the silver salt to metallic silver only in those areas where the received energy was sufficient to cause an ionic change. The chemical solution within the fixer tank has the property of halting the development cycle and when the film, after it is passed through the developer tank, is exposed to the fixer solution the unexposed silver salts are removed from the emulsion and the gelatin which contains the remaining metallic silver is hardened, thereby permanently storing or "fixing" the visible image.

The developing process is generally performed in a darkroom in order to prevent exposure of the film to light and the resulting weakening or destruction of the latent image. Commonly, the processor is installed in such a way that only the feed tray of its feed section is inside the darkroom and the rest of the processor is on the outside, and this approach allows maintenance of the processor without entering the darkroom. The automatic film processor may also be adapted for performing the entire processing outside the darkroom by the use of special cassettes or light-tight feed trays into which the film is loaded after exposure and unloaded directly into the processor without exposing the film to light, thus dispensing with the need for a darkroom altogether.

Returning now to FIG. 1, the subject X-ray film is passed from the feed station onto the rollers constituting the transport system 13 and first get passed through the developer tank 15 and subsequently through the fixer tank 16. The developed film then passes on to the wash tank 17 which contains externally supplied water and functions to remove residue fixer solution from the procesed film in order to prolong film as well as image storage life. From the wash tank 17 the film is normally passed through a series of squeegie rollers (not shown) that remove excess water in preparation for drying and provide a uniform squeezing motion in order to avoid drying artifacts. Subsequently the film passes into a dryer section 18 containing an electrically controlled dryer which passes air of constant temperature over the film exiting the wash tank 17 before it is conveyed to the output receiving bin 14. The dryer within the dryer section 18 is capable of maintaining a fairly constant temperature of drying air since variation from an optimum drying temperature can cause damage to the overall quality of the film. For example, inadequate dryer temperatures can result in damaged films which stick to one another and excessive temperatures can damage the processed film or the internal mechanisms of the film processor itself. Also associated with the main sections described above are other critical subsystems (not shown) such as the processor water supply system, the temperature regulation system, the chemical replenishment system, the solution recirculation system and the silver reclamation system; only those pertinent to this invention are described herein.

The progress of the film from the feed station 12 to the output bin 14 through the various sections of the processing section 13 is acomplished by means of a transport system 19, which generally includes discrete sets of rollers-cum-guide arrangements which control the path of the film through the processor.

Referring now to FIGS. 2 through 4, there is shown an illustrative automatic film processor 20 which essentially comprises a substantially rectangular hollow body 22 which houses the various sections constituting the processor. The processor body includes a developer tank 24, a fixer tank 26 and a wash tank 28 positioned rigidly yet in a removable manner within it. The developer and fixer tanks 24 and 26, serve to maintain a reservoir of developer and fixer solutions, repectively, and are made of a non-corrosive material that can withstand chemical attack from the developer and fixer solutions, facilitate easy cleaning and provide the proper environment for emersion time, temperature control and replenishment requirements. Although the size of the tanks themselves is not critical, it must be noted that reduced tank capacities are preferable because the corresponding decrease in the thermal mass and chemical reservoir helps maintain temperature and minimize variations in potency of the chemical solutions.

An integrated evaporation cover 30 is provided over the tank section of the rectangular body 22 and functions to reduce chemical evaporation, which can lead to gross deterioration of the rollers and subsequently to transport problems. The cover is particularly important if a low volume of film is to be handled, since evaporation causes oxidation of the developer resulting in a reduction of the solution's effectiveness as a reducing agent in the development reaction. The rectangular body 22 also has means to accommodate a feed tray 31 about a film feed entrance 32.

Each of the processor tanks is provided with a transport rack 34 which is essentially a roller/guide assembly including a pair of cylindrical rollers 36 positioned in such a way that they are in a parallel spaced relation adjacent to each other and lie in a horizontal plane parallel to the bottom of the tank into which they are to be positioned. The transport racks 34 also have a guide member 38 positioned below the horizontal rollers on the end proximate to the bottom of the tanks. The transport rollers 36 are connected to proper driving means capable of rotating the rollers in a direction mutually opposite to each other. The transport racks 34 function to transport the accepted film through the processing section and control its path through the processor, in conjunction with a series of gear belts and other links if required. An illustrative path for the film through the processing section is represented by a dashed-line contour in FIG. 3. The transport system controlling the transport racks may be provided with a variable speed drive so that films requiring special processing speeds such as Mammography films, may also be processed conveniently. It is essential that the rollers in the tanks have just enough pressure to provide reliable transport since the film emulsion is easily damaged and cannot tolerate excessive force. Each of the rollers must also provide a smooth surface and, in addition, the transport racks must be properly aligned in order to insure smooth film transport from the feed section to the dryer section and onto the output receiving bin.

The processor 20 also has a dryer section including a dryer transport rack 40 consisting of a pair of fed rollers 42 and a pair of exit rollers 44, positioned at the ends of a section of guide rails 46. The transport rack rollers and guide rails are so arranged that the X-ray film coming out of the wash tank 28 is caught by the feed rollers 42 and passed through the guide rails 46 and out through the output rollers 44. The dryer section is provided with a lower blower 48 within the rectangular body 22 of the film processor 20 and functions to blow warm air onto the lower surface of the film to be processed, in order to dry it. The film processor is also provided with a top blower 50 for blowing warm air onto the upper surface of the processed film in order to insure proper drying. The top blower is located within a pivotal top dryer section 52 which is normally positioned so that the blower 50 is capable of blowing warm air directly onto the top surface of the film (as shown in FIGS. 2 and 3). The top dryer section 52 may be opened outwards by virtue of its pivotal connection to the body of the processor in order to allow easy access to the transport rack of the dryer section (as shown in FIG. 1). The top dryer section also includes a temperature sensor 54 which serves to monitor and control the temperature of the air being blown onto the processed film in order to dry it, and a cleancycle indicator light 55 which is controlled by the control/indicator section (FIG. 1) of the processor so as to be turned on for the duration of the cleaning cycle as will be discussed below. An external output bin 56 is attached to the rear end of the film processor and functions as a receiving and storage area for the dried film coming out of the output rollers 44 of the dryer transport rack 40 and subsequently out of an exit slot 58 provided on the body of the film processor.

The normal sequence of operations involved in the processing of films by the illustrative processor of FIGS. 1–3 begins with the film being placed into the feed tray 31 and then being fed through the feed slot 32 to the first set of transport rollers 36 as defined by the transport rack 34 for the developer tank 24. This transport rack guides the film through the developer solution existing within the developer tank 24 and then feeds the film to the transport rollers 36 of the transport rack 34 for the fixer tank 26, which in turn guides the film through the fixer solution within the fixer tank 26 and onto the transport rollers 36 of the transport rack 34 for the wash tank 28. This transport rack then guides the film through the water existing within the wash tank 28 and guides the film out of the tank onto the feed rollers 42 off the dryer transport rack 40. This transport rack guides the processed film through the transport section during the course of which it is blown dry and then fed out through the output rollers 44 and the output slot 58 into the output receiving bin 56. It will be noted that the rack type of design as described above for the transport of film through the various compartment of the film processor eliminates the need for crossovers and also minimizes the possibility of jamming. Such a design also provides convenient means for draining the tanks within the processing section as well as in refilling them and contributes directly to a convenient and automatic cleaning arrangement of the processor, as will be described in detail below.

Referring now to FIGS. 5 through 10, there are shown representative diagrams of the various events which constitute the sequential cleaning procedure according to the system of this invention. Referring in particular to FIG. 5, the arrangement of key processor components for the drain cycles, which is the first event of the cleaning procedure, is illustrated. The three tanks 24, 26 and 28 of the processing section are provided with drain outlets 60, 62 and 64, respectively. The drainage arrangement itself is of the conventional gravity flow type with a wall or floor outlet. The drain outlets 60 and 62 of the developer and fixer tanks are each connected to solenoid operated valves 61 and 63 which are of the conventional type and may be actuated by turning the electrical power connection to them on or off depending on whether the valves are to be opened or closed, respectively. As shown in FIG. 5, the drain cycle involves the actuation of the drain valves 61 and 63 so that the used chemical solutions within the developer and the fixer tanks are drained out of their respective compartments. At this stage the wash compartment is not affected in any way and the wash water previously stored within the compartment is retained.

Figure 6:
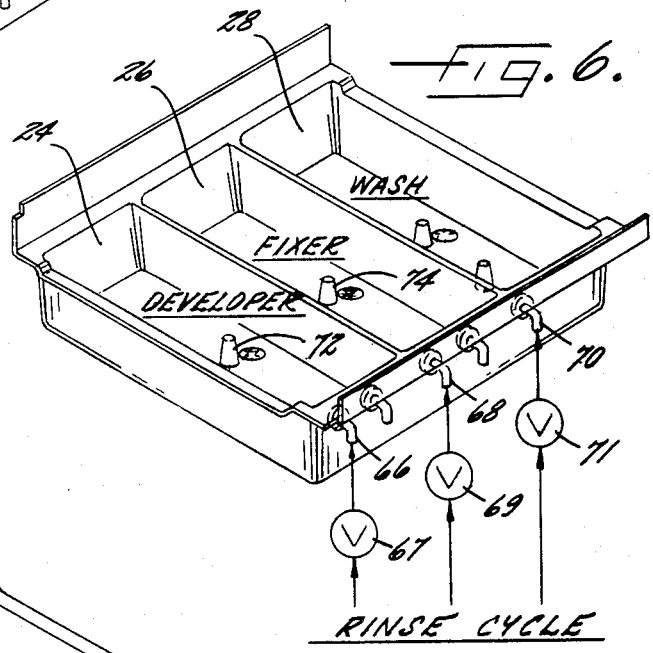
FIG. 6 is a representative diagram illustrating the action of the water inlet solenoid valves for the rinse cycle of the cleaning procedure.

Turning now to FIG. 6, there is illustrated the processor arrangement for the rinse cycle which is the event involved in the cleaning procedure according to this invention. At this stage the developer and the fixer tanks 24, 26 have been drained of their respective chemical solutions. The developer tank 24, the fixer tank 26 and the wash tank 28 are provided with inlet openings 66, 68 and 70, respectively. These inlets are in communication with the tap water supply through solenoid actuated valves 67, 69 and 71 at the location where the film processor is installed and hence when the valves are electrically activated at this step the developer, fixer and the wash compartments get filled with tap water. The duration for which the inlet valves remain open is predetermined and controlled by the electrical system timer, as will be discussed below.

Figure 7:
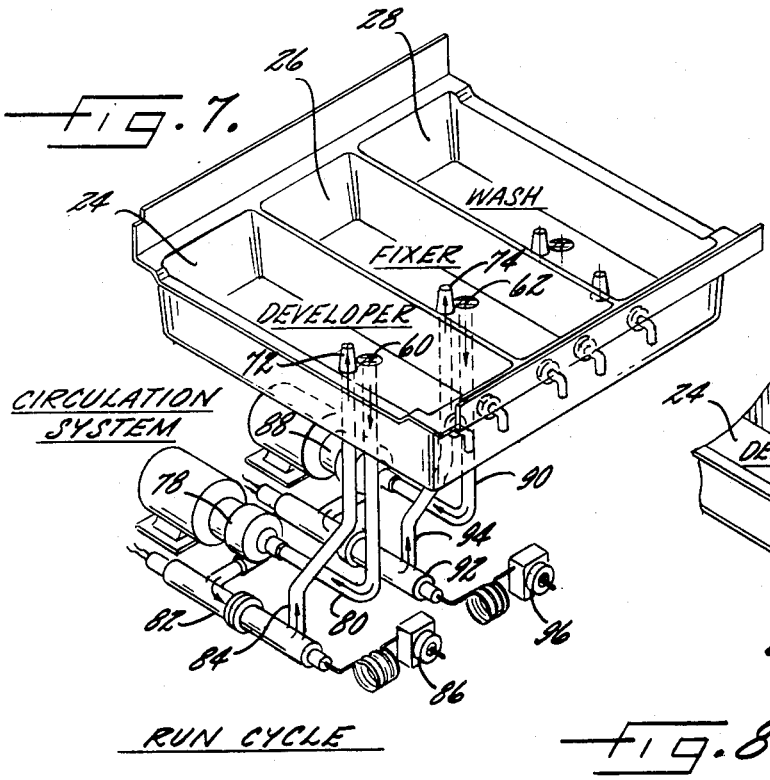
FIG. 7 is a representative diagram for the run cycle of the cleaning procedure also showing in perspective relevant portions of the circulation system.

Referring to FIG. 7 in particular, there is shown a representative diagram of the processor arrangement for the run cycle, which is the third event in the sequential cleaning procedure. This step constitutes an important portion of the overall cleaning procedure and involves a combination of events including the agitation of the rinse water that is used to fill up the chemical tanks by making use of the circulation system provided with the film processor, and the activation of the transport system so that the transport rollers are rotated in order to bring about the actual self-cleaning action according to this invention.

More specifically, in addition to the solenoid operated drain valves 61, 63, the developer and fixer tanks 24, 26 are also provided with recirculation inlet valves 72, 74, respectively. Separate circulation systems are provided for the developer and the fixer tanks, although the two circulation systems are identical structurally as well as operationally. More specifically, the developer tank drain outlet 60 is connected to a recirculation pump 78 through a flow tube 80. The pump 78 accepts the water from the developer tank and pumps it through a heater tube 82 into another flow tube 84 which conveys the recirculated water to the recirculation valve 72. The heater tube 82 functions to maintain the temperature of the recirculated water at a predetermined level on the basis of feedback from a thermostat 86. In effect, the circulation system accepts the rinse water from the developer tank and pumps it back into the developer tank after heating it up to a preset temperature.

The circulation system for the fixer tank is identical and uses the solenoid drain outlet 62 of the fixer tank to accept the rinse water and pass it to a circulation pump 88 through a flow tube 90. The pump 88 forces the water through a heater tube 92 and subsequently through another flow tube 94 back into the fixer tank through the recirculation valve 74. The heater tube 92, like the heater tube 82, functions to heat the recirculated rinse water to a predetermined temperature on the basis of feedback from a thermostat 96. The transport system is also activated as a part of this cleaning step, and the agitation of the rinse water brought about by the circulation system serves to clean the transport rollers as well as the guides and other mechanical components of the transport racks.

In order to bring about positive cleaning of the roller surfaces a means for scrubbing the rollers on the transport rack is provided, according to another feature of this invention. More specifically, a scrubber pad 98 is provided along with the processor accessories and is adapted to be manually positioned over the processing section in such a way that it comes into direct contact with the rollers 36 on the transport racks 34 and replaces the cover 34 of the processing section for the duration of the cleaning cycle (see FIG. 4). The pad has an active scrubbing surface made of a non-abrasive rubber or plastic material in the form of thin bristles or hooks which present a substantially rough external surface. At the beginning of the cleaning procedure or at the start of the run cycle the scrubber pad 98 is positioned over the processing section by opening the processor top cover, placing the scrubber pad over the transport racks and then reclosing the processor cover. In such a position the bristles on the scrubber pad come into positive contact with the rollers on the contact racks, and hence when, as part of the run cycle the transport mechanism is activated the scrubber pad rubs against the transport rollers and the resulting functional motion dislodges any accumulated chemicals on the surface of the transport rollers.

According to this invention, the scrubber pad is adapted to be conveniently replaceable when its scrubbing surface has deteriorated due to recurring use. More specifically, as shown in FIG. 4A, the scrubber pad 98 consists of an anchoring plate 98A onto which one mating section 98B of a conventional "VELCRO" strip is attached. The actual scrubbing surface is in the form of a mat 98C which has on its inactive surface the other mating section 98D of the "VELCRO" strip corresponding to the mating section 98B. In normal use, the mat 98C is securely attached to the anchoring plate 98A by pressing the two mating sections 98B and 98D together. When the scrubbing surface is worn due to use and needs to be replaced, the mating sections can be uncoupled easily and the scrubber mat replaced conveniently with a refill mat having a new scrubbing surface and the mating section of the "VELCRO" strip.

Simultaneous with the action of the transport system the agitation of the rinse water continues within the separate tanks of the processor and in combination with the scrubbing action described above results in efficient cleaning of the transport racks and related components. It will be understood that the activation of the circulation system as well as the transport system is controlled by the system timer on the basis of predetermined durations of time. By the end of the run cycle the transport racks are hence thoroughly devoid of chemical deposits which might have accumulated during the normal course of operation of the film processor and later caused degradation in the developing process..

Figure 8:
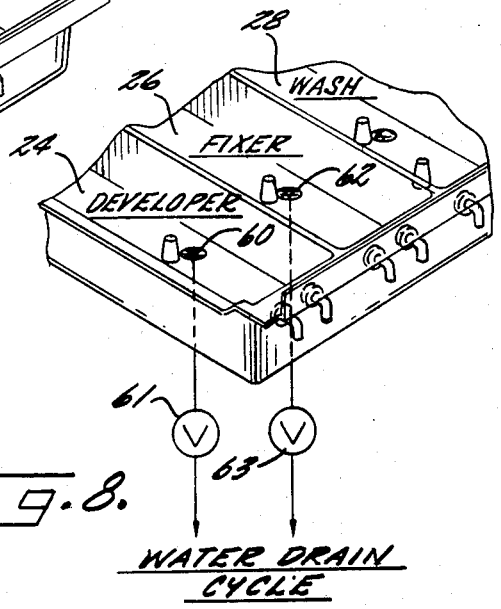
FIG. 8 is a representative diagram of the rinse water drain cycle of the cleaning procedure according to this invention.

The succeeding step is the water drain cycle where the recirculated rinse water which has been used to clean the developer and the fixer tanks is drained. A representative diagram for this step is shown in FIG. 8. The solenoid operated drain valves 61 and 63 are electrically activated so as to permit the waste water to be drained out of the developer and fixer tanks. Again, the duration for which the drain valves are kept open is controlled by the system timer on the basis of predefined time intervals. At the conclusion of this step the developer and the fixer tanks are cleaned and drained of the waste water from the run cycle.

Figure 9:
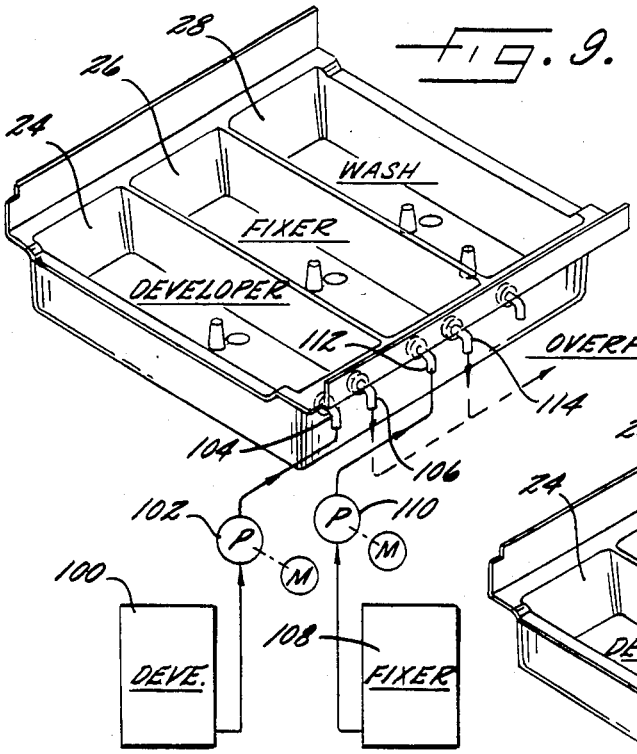
FIG. 9 is a representative diagram illustrating the chemical refill cycle for the developer and fixer compartments.

Referring now to FIG. 9, there is shown a representative diagram for the chemical refill cycle of the cleaning procedure according to this invention. As shown, the developer tank is provided with a developer replenishment tank 100 and a refill pump 102 which functions to pump the developer solution from the replenishment tank 100 into the developer tank through a refill inlet 104. The refill pump 102 is of the meterized kind and can be adjusted to provide a desired volume of chemical solution each time it is activated. The developer tank 24 is also provided with an overflow outlet 106 and serves to drain out any excess developer solution pumped into the tank by the refill pump. According to this invention, the meterized refill pump is adjusted so that it is capable of delivering a little more than the actually required volume of developer solution during the refill process. Specifically, this adjustment is made in such a way that the delivered amount of developer solution extends to a little beyond the optimal level of solution at which the overflow outlet 106 is located. Hence, each time the refill pump for the developer is activated the volume of solution delivered into the developer tank produces a liquid level higher than that of the overflow outlet 106 and, subsequently, once the refill pump 102 has been shut off the excess developer solution flows out of the overflow outlet 106 and is externally drained away. This arrangement insures that after the refill process just the exact volume of developer solution exists within the developer tank.

A similar arrangement for refilling the fixer tank 26 is also provided. More specifically, the film processor is also provided with a fixer replenishment tank 108 which in conjunction with a refill pump 110 is used to refill the fixer tank with a required amount of fixer chemical solution through a refill inlet 112 located within the fixer tank 26. As with the case of the developer refill arrangement, the pump 110 is a meterized pump capable of being adjusted to deliver a predetermined volume of fixer solution into the fixer tank. The fixer tank is also equipped with an overflow outlet 114 which functions to relieve the fixer tank of any excess chemical solution delivered to it by the refill pump. The refill pump 110 is adjusted so that each time it is activated it delivers a volume of fixer solution which extends to a level higher than the optimal solution level at which the overflow outlet 114 is located. Hence, after the pump 110 has delivered the predetermined volume of fixer solution into the fixer tank, the excess volume of solution drains out of the overflow outlet 114 so that the fixer tank is left with just the exact required volume of fixer solution within it. The overflow outlets 106 and 114 of the developer and the fixer tanks 24 and 26 respectively are connected to a common drain manifold for the film processor. At the end of the refill step excess chemical solutions from these two tanks are carried away by the overflow outlets through a manifold drain (not shown). It will be noted that the chemical refill system described above may also be adapted to have automatic chemical injection facility in order to maintain constant developer and fixer strengths.

Figure 10:
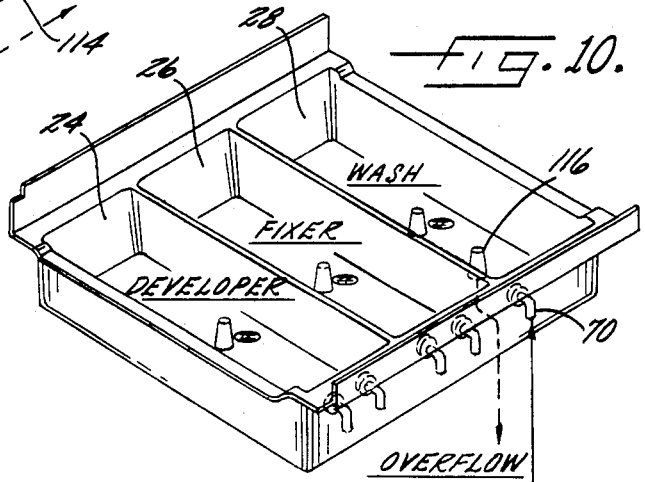
FIG. 10 is a representative diagram illustrating the wash water refill cycle of the cleaning procedure according to this invention.

Referring now to FIG. 10, there is shown a representative diagram of the water refill cycle which is the final step of the sequential cleaning procedure according to this invention. The wash tank 28 is provided with an overflow outlet 116 located at a level which defines the requisite volume of wash water for the wash tank. As part of the final step the solenoid operated inlet valve 71 is activated so that tap water is added to the wash compartment 28 and this effectively causes the water level to rise above the optimum level defined by the overflow outlet 116 and the resultant excess water flows out of the overflow outlet 116. According to a feature of this invention, the overflow outlet 116 is also connected to the drain manifold for the film processor into which the chemical solutions which flow out of the developer tank overflow outlet 106 and the fixer tank overflow outlet 114 are directed. Hence, when the solenoid operated valve 71 adds fresh water to the wash tank causing excess water to overflow out of the outlet 116, the overflowing water effectively flushes the earlier overflow chemicals from the developer and fixer tanks down the drain manifold and away from the film processor and prevents the accumulation of exhausted chemicals around the drain manifold and subsequent damage due to corrosion. After a predetermined time period as defined by prior adjustments to the system timer, the solenoid operated valve 71 is deactivated and the water level in the wash tank 28 stabilizes and marks the completion of the sequential cleaning procedure. At this stage the special scrubber pad 98 is removed from its contacting position with the transport rollers within the processing section and once the cover 30 for the film processor is replaced it is ready to resume normal processor operation.

FIG. 12 shows a flow diagram representation 130 of the sequence in which the various cycles involved in the sequential cleaning procedure according to the system of this invention are activated. At the beginning of the cleaning procedure it is insured that the normal operation of the processor is discontinued and is so indicated by the turning on of the cleaning-cycle indicator light 55 (step 131). At the subsequent step 132 the special scrubber pad is manually positioned onto the transport rollers within the processing section of the film processor. At step 133 the chemical drain cycle is initiated resulting in the drainage of the used chemical solutions from the developer and the fixer tanks. The initiation of the chemical drain cycle also marks the beginning of the control cycle of the system timer 120, as represented by the schematic diagram of FIG. 11, which illustrates the predefined time durations on the basis of which the system timer controls the various valves and sub-systems in order to perform the sequential cleaning procedure of this invention. For the duration of the chemical drain cycle, the solenoid operated drain valves 61, 63 of the developer and fixer tanks 24, 26 respectively are activated by the timer so that they are open for a predetermined duration of time $\theta_1$.

Figure 11:
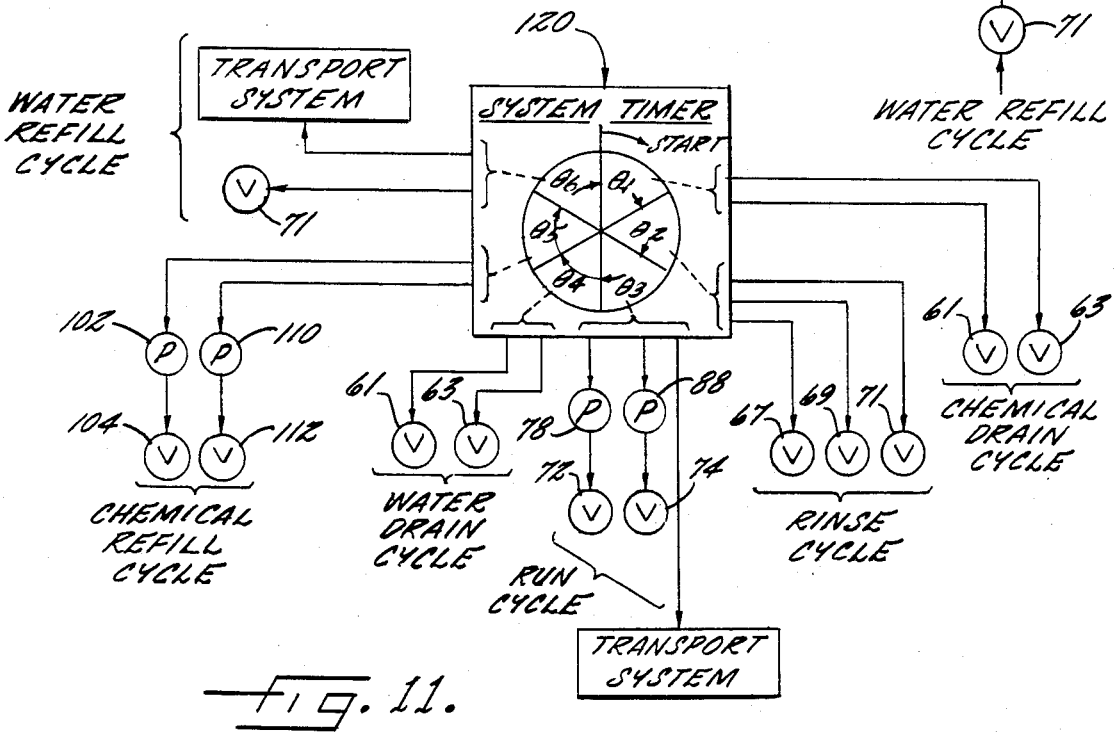
FIG. 11 is a schematic diagram of the overall control of the solenoid valves and the transport and recirculation systems of the film processor using an electrical cycle timer according to the system of this invention.

In FIG. 12, the subsequent step 134 involves the rinse cycle where fresh tap water is added to the developer, the fixer and the wash tanks of the processing section. For the duration of the rinse cycle the system timer activates the solenoid operated inlet valves 67, 69 and 71 of the developer, fixer and the wash tanks 24, 26 and 28, respectively, for a predetermined duration of time $\theta_2$ (FIG. 11). At step 135 the run cycle takes place wherein the system timer 120 activates the transport system, the recirculation pumps 78, 88 and the refill valves 72 and 74 for a predetermined duration of time $\theta_3$ (FIG. 11). The following step in FIG. 12 is the water drain cycle at step 136 wherein the system timer activates the solenoid operated drain valves 61, 63 of the developer and the fixer tanks 24, 26 respectively so that the rinse water may be drained away from the chemical tanks. The timer controls the valves 61 and 63 so that they remain actuated for a predetermined duration of time $\theta_4$ (FIG. 11).

At step 137 the chemical refill cycle takes place wherein the system timer activates the replenishment pumps for the developer and the fixer tanks, respectively, for a predetermined time duration $\theta_5$ (FIG. 11) so that these tanks are refilled with fresh chemical solutions from the respective replenishment tanks provided with the film processor. At step 138 the water refill cycle takes place wherein the system timer activates the water inlet valve 71 of the wash tank 28 so that fresh tap water is added to the existing water within the wash tank. Simultaneously, the timer also activates the transport system so that the transport rollers start rotating and agitate the freshly filled developer and fixer tank solutions in order to insure a uniform distribution of the chemicals before film processing is resumed. The timer controls the transport system and the water inlet valve 71 during the water refill cycle in such a way that they are actuated for a predetermined time duration $\theta_6$ (FIG. 11). At the expiration of this time duration the system timer reaches the end of its control cycle and this marks the end of the sequential cleaning procedure. Returning to FIG. 12, at step 139 the scrubber pad is manually removed from its position over the transport rollers within the processing section and replaced with the cover 30 of the processor. Finally, at step 140 the film processor is ready to resume normal film processing operation and this is indicated by the turning off of the cleaning-cycle indicator light 55 (FIG. 2).

As is apparent from the description above, the system of the present invention provides a simple and conveniently automated means of self cleaning for automatic film processors. The illustrative embodiment makes use of a minimal number of discrete components and shows how conventional film processors may be easily adapted to the self-cleaning mode according to this invention. The invention thus provides a self cleaning film processor which dispenses with the complicated, tedious and costly procedures involved with conventional manual cleaning of film processors and yet does this in an embodiment which is simple, compact and economical, has significantly improved operational life as well as efficiency and requires reduced repair and maintenance.

It will be understood that the time duration parameters $\theta_1$–$\theta_6$ that control the duration of the various cleaning events can be varied by conveniently adjusting the system timer in order to adapt the film processor for self-cleaning under different conditions and applications.

I claim:

1. A film processor for developing X-ray films or the like, having automatic self-cleaning capability, said processor comprising:

a developer section for holding a volume of developer solution;

a fixer section for holding a volume of fixer solution;

a wash section for holding a volume of wash solution;

each of said sections having transport means removably disposed within it and operative to accept the film at an input end and passing the film through the section to an output end;

separate means for automatically draining said developer, fixer and wash sections;

means for automatically filling said developer, fixer and wash sections with either their respective solutions or with water;

means for circulating water through said developer and fixer sections; and automatic control means for coordinating the sequence of operation of said draining, filling, circulating and transport means according to a predefined cleaning cycle in order to provide the processor with the self-cleaning capability.

2. The self-cleaning processor of claim 1 wherein the cleaning cycle comprises the steps of activating said draining means of said developer and fixer sections for a predetermined time period in order to drain them of the developer and fixer solutions, respectively, activating said filling means of said developer and fixer sections for a predetermined time period in order to fill them with clean water, activating the transport means and the circulating means for a predetermined time period so that the relative movement of the transport means and the circulating water cleans the transport means as well as the developer, fixer and wash sections, activating the draining means of said developer and fixer sections for a predetermined timer period in order to drain the sections of the used water, and activating the refilling means of the drained developer and fixer sections for a predetermined time period to refill the sections with fresh developer and fixer solutions respectively.

3. The self-cleaning processor of claim 1 wherein said automatic draining means include drain outlets with solenoid operated valves linked to the control means of the processor.

4. The self-cleaning apparatus of claim 3 wherein said filling means for the developer and fixer sections each include replenishment tanks, containing the respective chemical solutions, connected through motorized pump means to inlet ports on said sections.

5. The self-cleaning apparatus of claim 4 wherein said circulating means include motorized pump means for circulating water from outlet ports on said sections to the pump means and back from said pump means to inlet ports for said sections.

6. The self-cleaning apparatus of claim 5 wherein said circulating means also includes a thermostatically controlled heater tube operative to heat the circulating water to a predefined temperature.

7. The self-cleaning apparatus of claim 2 or claim 6 wherein the processor also includes means for frictionally co-acting with said transport means during the cleaning cycle of the processor in such a way that the active surfaces of said transport means are maintained substantially free of surface accumulations.

8. The self-cleaning processor of claim 7 wherein said coacting means is in the form of a scrubber pad having a substantially rough surface made of a nonabrasive material such as plastic or rubber, said pad being operative to produce a scrubbing action when the rough surface of the pad contacts the operating transport means during the cleaning cycle of said processor.

9. The self-cleaning film processor of claim 8 wherein said scrubber pad is adapted to be manually placed into contact with the transport means for the duration of the cleaning cycle.

10. The self-cleaning film processor of claim 8 wherein said scrubber pad is adapted to be automatically placed into contact with the transport means for the duration of the cleaning cycle.

11. In a film processor for developing X-ray films or the like, including a developer section for holding a volume of developer solution, a fixer section for holding a volume of fixer solution, a wash section for holding a volume of wash solution, and transport means disposed within each of said sections for transporting the film through the sections, the improvement comprising means for automatically draining said developer, fixer and wash sections, means for automatically filling said developer, fixer and wash sections with either their respective solutions or with water, means for automatically circulating water through said developer and fixer sections, means for frictionally coacting with said transport means in such a way as to make the transport means substantially free of surface accumulations, and automatic control means for coordinating the sequence of operation of said draining, filling, circulating and transport means according to a predefined cleaning cycle in order to provide the processor with self-cleaning capability.

12. The film processor of claim 11 wherein the cleaning cycle comprises the steps of activating said draining means of said developer and fixer sections for a predetermined time period in order to drain them of the developer and fixer solutions, respectively, activating said filling means of said developer and fixer sections for a predetermined time period in order to fill them with clean water, activating the transport means and the circulating means for a predetermined time period so that the relative movement of the transport means and the circulating water cleans the transport means as well as the developer, fixer and wash sections, activating the draining means of said developer and fixer sections for a predetermined time period in order to drain the sections of the used water, and activating the refilling means of the drained developer and fixer sections for a predetermined time period to refill the sections with fresh developer and fixer solutions respectively.

13. The film processor of claim 11 wherein said automatic draining means include drain outlets, with solenoid operated valves linked to the control means of the processor.

14. The film processing apparatus of claim 13 wherein said filling means for the developer and fixer sections each include replenishment tanks, containing the respective chemical solution, connected through motorized pump means to inlet ports on said sections, and said circulating means include motorized pump means for circulating water from outlet ports on said sections to the pump means and back from said pump means to inlet ports for said sections, and heater means for heating the circulating water to a predefined temperature.

15. The film processor of claim 11 wherein said coacting means is in the form of a scrubber pad having a substantially rough surface made of a nonabrasive material such as plastic or rubber, said pad being operative to produce a scrubbing action when the rough surface of the pad contacts the operating transport means during the cleaning cycle of said processor.

16. The film processor of claim 8 or claim 15 wherein said scrubber pad includes a support plate to which the rough scrubbing surface is attached in a removable manner, thereby permitting easy replacement of the scrubbing surface.

* * * * *